US005856653A

United States Patent [19]

Boudreaux

[11] Patent Number: 5,856,653

[45] Date of Patent: Jan. 5, 1999

[54] MASCARA EXTENDER

[76] Inventor: Nona Boudreaux, 92 Charles Byrd Rd., Poplarville, Miss. 39470

[21] Appl. No.: 662,972

[22] Filed: Jun. 13, 1996

[51] Int. Cl.[6] ..... F27D 11/02; F27B 14/14

[52] U.S. Cl. ..... 219/439; 219/386

[58] Field of Search ..... 219/385–387, 219/421, 424–426, 430, 439, 441, 433; 392/443, 444; 264/404

[56] References Cited

U.S. PATENT DOCUMENTS

| | | | |
|---|---|---|---|
| 2,279,000 | 4/1942 | Larson | 219/439 |
| 3,091,681 | 5/1963 | Mayer | 215/227 |
| 3,294,039 | 12/1966 | Ogden | 219/439 |
| 3,385,954 | 5/1968 | Rabinowitz et al. | 215/227 |
| 3,463,140 | 8/1969 | Rollor | 219/439 |
| 3,607,134 | 9/1971 | Mcintyre | 218/386 |
| 3,609,297 | 9/1971 | Christopoulos | 219/439 |
| 3,723,704 | 3/1973 | Silverthorne | 215/227 |
| 3,764,780 | 10/1973 | Ellis | 219/430 |
| 3,805,018 | 4/1974 | Luong et al. | 219/387 |
| 4,256,697 | 3/1981 | Baldwin | 219/433 |
| 4,376,096 | 3/1983 | Bowen | 219/441 |
| 4,528,439 | 7/1985 | Marney et al. | 219/386 |
| 4,659,911 | 4/1987 | Ryder et al. | 219/439 |
| 5,116,578 | 5/1992 | Baxter | 422/63 |
| 5,220,152 | 6/1993 | Doran | 215/227 |
| 5,459,300 | 10/1995 | Kasman | 219/433 |
| 5,700,991 | 12/1997 | Osbern | 219/386 |

*Primary Examiner*—Teresa J. Walberg
*Assistant Examiner*—J. Pelham
*Attorney, Agent, or Firm*—Kenneth L Tolar

[57] ABSTRACT

A container with a compartment into which a container of cosmetics is placed, and a heating element in the walls of the container. The heating element is connected to a source of electricity which heats the heating element which in turn heats a fluid within the walls of the container. The heated fluid warms the cosmetics which will make it usable once again.

9 Claims, 2 Drawing Sheets

MASCARA EXTENDER

BACKGROUND OF THE INVENTION

This invention relates, in general to an electrically powered heater, and, in particular, to a heater which will heat containers of mascara that have dried up in order to make the mascara usable again.

DESCRIPTION OF THE PRIOR ART

In the prior art various types of heaters have been proposed. For example, U.S. Pat. No. 3,091,681 discloses a heater for bowling balls that has a cord with a plug that engages a cigarette lighter socket in a car on one end, and a plug that will fit into the finger holes on a bowling ball on the other end.

U.S. Pat. No. 3,385,954 discloses an electrically operated tool for melting wax for use in encaustic painting which has a plurality of containers for the wax and a soldering iron type heating element that engages and heats the containers.

U.S. Pat. No. 3,723,704 discloses a cautery apparatus which has a coil of wire that is heated by an electrical connector that is plugged into an AC outlet.

U.S. Pat. No. 5,220,152 discloses a lock thawing device which has a rechargeable battery that is recharged by plugging the device into an AC outlet, and a probe that is heated by the battery and placed inside a lock to thaw it.

However, none of the prior art devices has recognized the problem of cosmetics which have become clumped, dried and hardened with age and how to soften the cosmetics to make them useful again.

SUMMARY OF THE INVENTION

The present invention consists of a container with a compartment into which a container of cosmetics is placed, and a heating element in the walls of the container. The heating element is connected to a source of electricity which heats the heating element which in turn heats a fluid within the walls of the container. The heated fluid warms the cosmetics which will make it usable once again.

It is an object of the present invention to provide a new and improved heater for cosmetics.

It is an object of the present invention to provide new and improved heater for cosmetics that will evenly heat an entire container of cosmetics.

It is an object of the present invention to provide new and improved heater for cosmetics that is safe and convenient to operate.

These and other objects and advantages of the present invention will be fully apparent from the following description, when taken in connection with the annexed drawings.

DESCRIPTION OF THE PREFERRED EMBODIMENT

Figure 1:
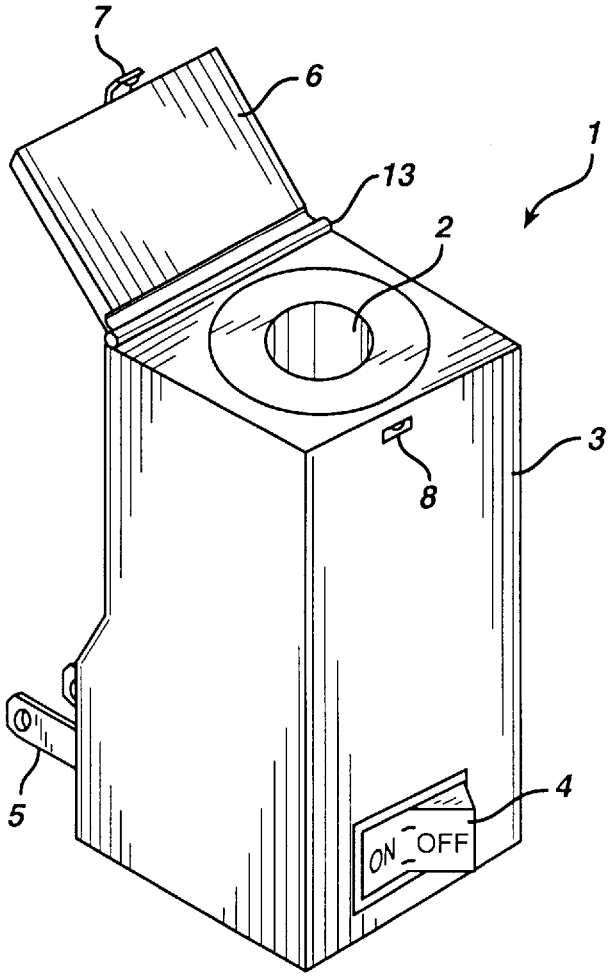
FIG. 1 is a perspective view of the present invention.

Referring now to the drawings in greater detail, FIG. 1 shows a perspective view of the present invention 1 which comprises a housing 3 which has a lid 6 hinged to the top of the housing by any type of conventional hinge 13. The lid 6 has a catch 7 which cooperates with a second catch 8 on the housing 3 to hold the lid in a close disposition when not in use. The catches are not critical and any type of catch that will hold the lid 6 closed when the device is not being used will suffice.

Figure 2:
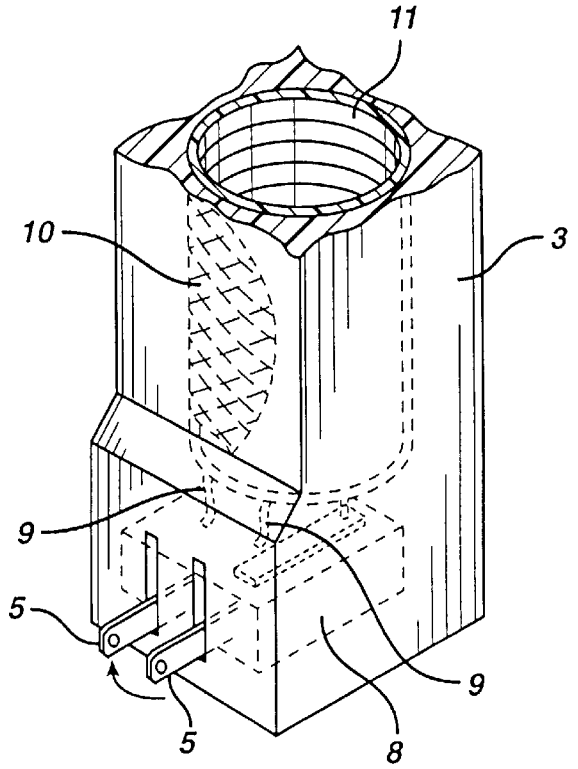
FIG. 2 is a partial view of the present invention showing the heating chamber.

At the bottom of the housing 3 is an on-off switch 4 for a purpose to be explained below. At the back of the housing are a pair of electrical contacts 5 which will plug into a conventional 110 volt outlet in order to supply power to the heater. As shown more clearly in FIG. 2, the contacts 5 can pivot into the housing 3 when they are not needed. These contacts are conventional in the heating art and are similar to the rotating contacts used in U.S. Pat. No. 5,220,152, which is hereby incorporated by reference. Other types of movable contacts, such as sliding contacts which will slide back into the housing 3 could also be used. The exact type of movable contacts used are not critical and as long as the contacts can be moved to a non-use position when they are not needed, they can be incorporated into the present invention.

Contained within the bottom of the housing 3 is a timer 8 which can be any conventional electrical timer which can be factory set to a preselected time interval, such as five minutes. When electricity is supplied to the unit through the contacts 5 and the electrical connections 9 within the housing, and the switch 4 is turned on, the timer will allow electricity to flow into the unit for five minutes and then will automatically turn off the unit. This is a safety factor built into the unit so a user will not forget to turn the unit off after using, thereby damaging the unit, or risking a fire if the unit overheats. The timer 8 and switch 4 can be any conventional components that will perform the intended functions.

Figure 3:
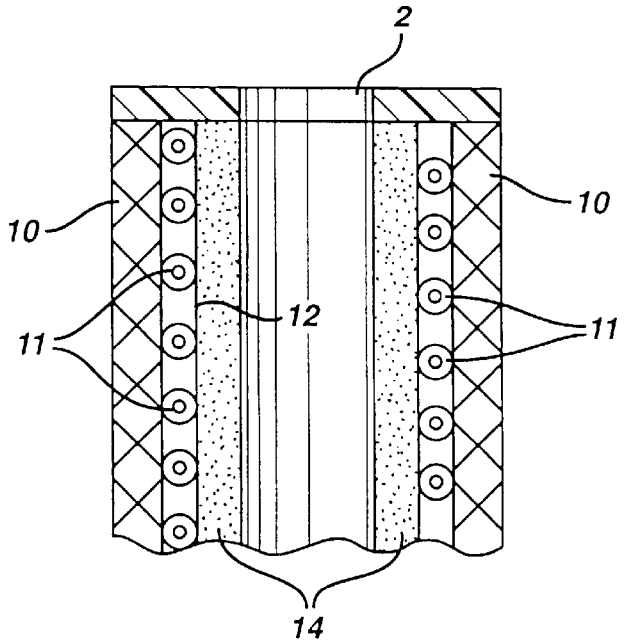
FIG. 3 is a partial view of the heating chamber of the present invention.

The housing 3 has a well 2, shown in FIGS. 1 and 3, which will accept a bottle or container of mascara (not shown). Surrounding the well 2 is a circular outer wall defining a sealed, cylindrical chamber 12 therebetween. The circular wall is made from soft, silicone rubber foam tubing or a similar material. The soft silicone will allow different sizes of bottles or containers to be placed within the well 2. The chamber 12 is filled with a liquid or silicon thermal gel 14 which can be heated. Surrounding the chamber 12 is a spiral heating coil 11 which is electrically connected to the contacts 5 by electrical connections 9.

When the contacts are plugged into an electrical receptacle, and the switch 4 is turned on, electricity will heat the coil 11 for approximately five minutes before the timer 8 automatically interrupts electrical power to the coil 11. This will be sufficient time for the coil 11 to heat the liquid or gel in the chamber 12, which will in turn heat the mascara in the well 2. Since the liquid or gel, in the chamber 12, completely surrounds the well 2, the mascara container will be evenly heated, thus insuring a more complete recovery of the hardened mascara. If the liquid or gel, in the chamber 12, were eliminated, the coils alone would heat the mascara only in the areas occupied by the heating coils. This could result in an uneven heating of portions of the mascara and all the mascara might not be recovered.

Although the disclosure has focused on heating and thereby recovering mascara that has hardened with age, the present invention is not limited to use with only a mascara product. It could be used with any type of product that will benefit from heating such as, but not limited to, wax, nail polish and facial hair waxing compound.

The housing 2 and the lid 6 are preferably made from ABS plastic (although other material could be used) using a plastic injection molding process. This plastic molding process utilizes heat softened plastic material which is forced under very high pressure into a metal cavity mold which is relatively cool. The inside cavity mold is comprised of two or more halves and is the same desired shape as the product to be formed. High pressure hydraulics are used to keep the mold components together during the actual injection phase of the molding process. The injected plastic is allowed to cool and harden. The hydraulics holding the multiple component cavity together are released, the halves of the mold separated and the solid formed plastic item is removed. This process can easily be automated and is capable of producing extremely detailed parts at a very cost effective price.

The retractable power plug 5 is molded into place within the injection mold cavity. The switch 4 is a conventional rocker type on-off switch, which is the preferred type of switch, however any switch which will perform the intended function could be used.

The thermal gel 14 is a thick silicon gel which will transmit heat evenly. The gel can be placed within the sleeve 12 using an industrial syringe and will not make contact with the heating coil.

The electrical heating element 11 is manufactured of nickel chrome resistance wire (although other materials could also be used). The heating element could be wound around the tube 12 and then a fiberglass cloth 10 could be places around the coils to insulate the outside of the housing 2 from heat transfer.

The timer could be any conventional timer, however the preferred timer is a bi-metal strip which "kicks open" after the unit has been on for a preselected time, such as five minutes, or after the heating unit reaches a preselected temperature such as 90° to 1000° F.

Although the Mascara Extender and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A heating apparatus for heating a dried, unusable cosmetic comprising:

a small, compact housing made from a non-conductive material having a top and bottom end with an aperture on its top end in communication with an elongated, substantially cylindrical well, said well dimensioned to receive and tightly surround a cosmetic container;

an outer wall surrounding said well forming an integral sealed annular chamber therebetween, said chamber having a heatable fluid therein;

an electrically powered heating element surrounding said outer wall for providing heat to a cosmetic container received within said well so that dried unusable cosmetic stored within said container will revert to a usable form.

2. A device according to claim 1 further comprising a lid hingedly engaging the top end of said housing and securable thereto for selectively covering said aperture to enclose said well.

3. A device according to claim 2 wherein said heating element comprises an electrical wire helically wound about the exterior surface of said outer wall.

4. A device according to claim 3 further comprising a fiberglass layer wrapped about said electrical wire for retaining heat within said annular chamber.

5. A device according to claim 4 further comprising a plug assembly retractable within said housing and in communication with said heating element for providing electricity thereto.

6. A device according to claim 5 further comprising a switch means in communication with said plug assembly for selectively activating said heating element.

7. A device according to claim 6 further comprising a timer means in communication with said switch means for permanently disabling power to said heating element upon the expiration of a predetermined duration.

8. A device according to claim 7 wherein said outer wall is constructed of silicone foam rubber allowing said chamber to expand.

9. A device according to claim 8 wherein said heatable fluid is a viscous, silicon gel.

* * * * *